US006993943B1

(12) United States Patent
Chang

(10) Patent No.: US 6,993,943 B1
(45) Date of Patent: Feb. 7, 2006

(54) ELECTRIC PADLOCK

(75) Inventor: Jing-Chen Chang, Yun-Lin Hsien (TW)

(73) Assignee: EZ Trend Technology Co., Ltd., Chia-Yi (TW)

( * ) Notice: Subject to any disclaimer, the term of this patent is extended or adjusted under 35 U.S.C. 154(b) by 0 days.

(21) Appl. No.: 11/189,362

(22) Filed: Jul. 26, 2005

(51) Int. Cl.
*E05B 67/22* (2006.01)

(52) U.S. Cl. ..... 70/38 B; 70/38 A; 70/38 C; 70/52; 70/277

(58) Field of Classification Search ..... 70/38 A–38 C, 70/51, 52, 63, 257, 277, 279.1–283.1
See application file for complete search history.

(56) References Cited

U.S. PATENT DOCUMENTS 3,835,675 A * 9/1974 Lippisch ..... 70/38 A
4,556,872 A * 12/1985 Masoncup et al. ..... 340/542
4,609,780 A * 9/1986 Clark ..... 379/102.06
4,838,052 A * 6/1989 Williams et al. ..... 70/63
4,929,880 A * 5/1990 Henderson et al. ..... 320/134
5,280,518 A * 1/1994 Danler et al. ..... 379/102.06
5,561,996 A * 10/1996 Chang ..... 70/247
6,047,575 A * 4/2000 Larson et al. ..... 70/278.1
6,401,501 B1 * 6/2002 Kajuch et al. ..... 70/25
6,442,983 B1 * 9/2002 Thomas et al. ..... 70/38 A
6,761,051 B1 * 7/2004 Tsai ..... 70/38 B
6,792,779 B1 * 9/2004 Shen ..... 70/38 B
6,834,519 B1 * 12/2004 Yang ..... 70/58
6,898,952 B1 * 5/2005 Lin ..... 70/38 B

* cited by examiner

*Primary Examiner*—Suzanne Dino Barrett
(74) *Attorney, Agent, or Firm*—David N. Lathrop, Esq.; Gallagher & Lathrop

(57) ABSTRACT

An electric padlock includes a lock casing, a shackle member, a latch member, and a battery cap unit. The lock casing is formed with a receiving space for receiving a battery unit, a battery access hole, and an insert groove disposed adjacent to the battery access hole. The latch member is received in the lock casing, and is movable for locking and unlocking the shackle member relative to the lock casing. The battery cap unit includes a battery cap member mounted movably on the lock casing for closing selectively the battery access hole, and a retaining member provided movably on the battery cap member to engage the insert groove when in a retaining position such that opening movement of the battery cap member can be inhibited when the shackle member is locked on the lock casing.

14 Claims, 9 Drawing Sheets

ELECTRIC PADLOCK

BACKGROUND OF THE INVENTION

1. Field of the Invention

The present invention relates to an electric padlock, more particularly to an electric padlock that can prevent unauthorized removal of a battery unit therein.

2. Description of the Related Art

A conventional electric padlock includes a lock casing formed with two shackle insert holes. A shackle member has a longer leg portion that is movably disposed in one of the shackle insert holes and that is biased upwardly. A latch member is received in the lock casing, and is movable between locking and unlocking positions for engaging and disengaging a shackle groove in a shorter leg portion of the shackle member. The electric padlock further includes an electric operating unit that has a drive motor mounted in the lock casing, coupled to the latch member, and operable for moving the latch member between the locking and unlocking positions.

The electric operating unit draws electric power from a battery unit that is received in a battery compartment of the lock casing. The lock casing is formed with a battery access hole so as to permit insertion of the battery unit into and removal of the battery unit from the battery compartment. A battery cap member is mounted removably on the lock casing for closing selectively the battery access hole.

The conventional electric padlock is disadvantageous in that, since the battery cap member can be removed regardless of whether the shackle member is locked or unlocked from the lock casing, the electric padlock can be vandalized by simply removing the battery unit from the battery compartment while the shackle member is locked on the lock casing. Without the battery unit, the electric operating unit is no longer operable for unlocking the shackle member from the lock casing.

SUMMARY OF THE INVENTION

Therefore, the object of the present invention is to provide an electric padlock that can overcome the aforesaid drawback associated with the prior art.

Accordingly, an electric padlock of the present invention comprises a lock casing, an inverted U-shaped shackle member, a latch member, and a battery cap unit.

The lock casing confines a receiving space that is adapted for receiving a battery unit, and has a first end wall formed with first and second shackle insert holes, and a second end wall that is opposite to the first end wall and that is formed with a battery access hole. The battery access hole permits insertion of the battery unit into and removal of the battery unit from the receiving space. The lock casing is formed with an insert groove in spatial communication with the receiving space and disposed adjacent to the battery access hole.

The shackle member has first and second leg portions that are extended movably into the lock casing at the first and second shackle insert holes, respectively. One of the first and second leg portions is formed with a shackle groove.

The latch member is received in the lock casing, and is movable between a locking position in which the latch member engages the shackle groove so as to lock the shackle member on the lock casing, and an unlocking position in which the latch member is disengaged from the shackle groove so as to unlock the shackle member from the lock casing.

The battery cap unit includes a battery cap member and a retaining member. The battery cap member is mounted movably on the lock casing for closing selectively the battery access hole. The retaining member is provided movably on the battery cap member, is disposed in the receiving space when the battery cap member closes the battery access hole, and is movable between a retaining position, where the retaining member engages the insert groove so as to inhibit opening movement of the battery cap member, and are leasing position, where the retaining member is disengaged from the insert groove so as to permit opening movement of the battery cap member.

One of the first and second leg portions of the shackle member is provided with a release-control segment adjacent to the battery access hole such that, when the shackle member is unlocked from the lock casing and is subsequently rotated relative to the lock casing, the release-control segment is capable of driving movement of the retaining member from the retaining position to the releasing position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
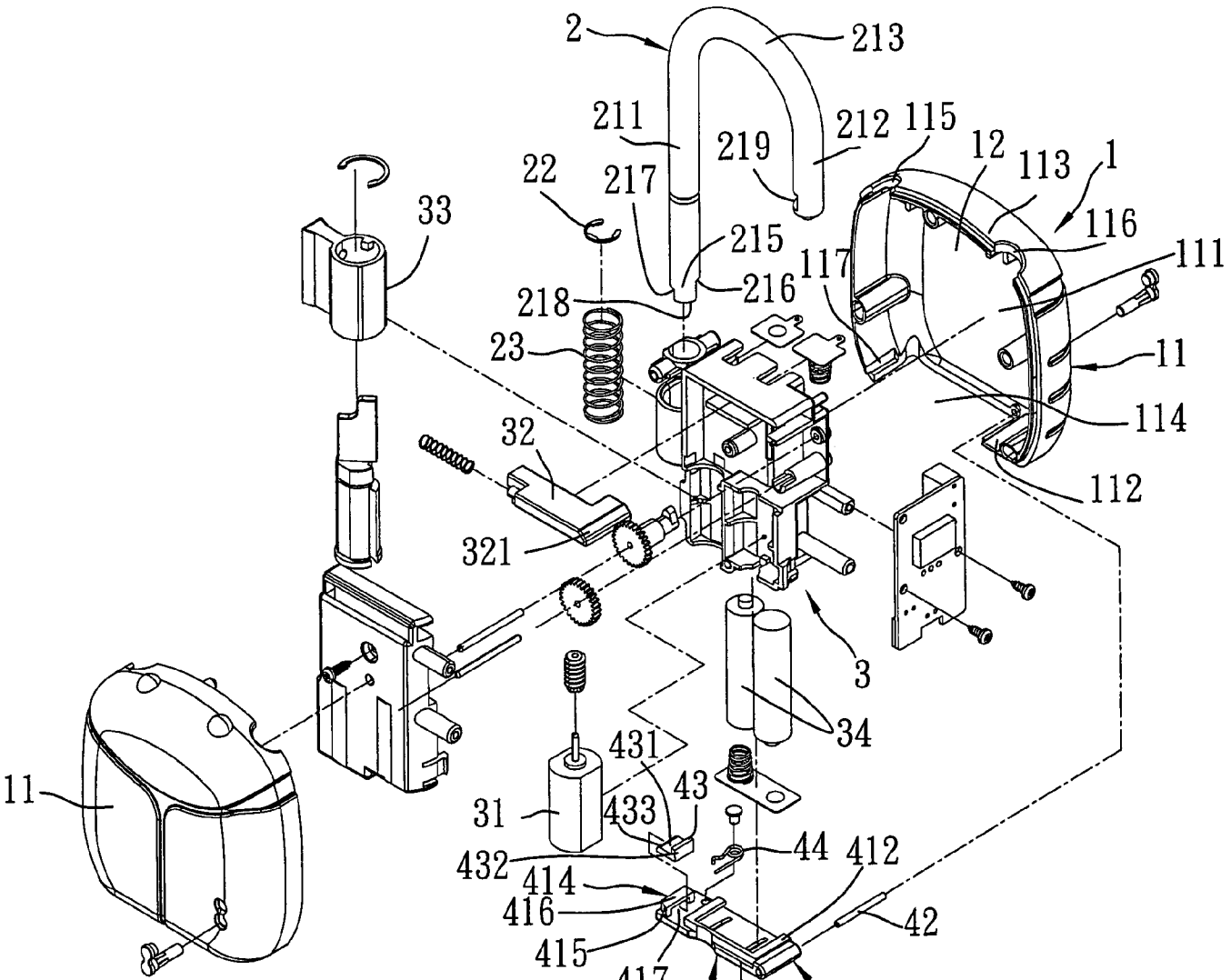
FIG. 1 is an exploded perspective view of the preferred embodiment of an electric padlock according to the present invention.
Figure 2:
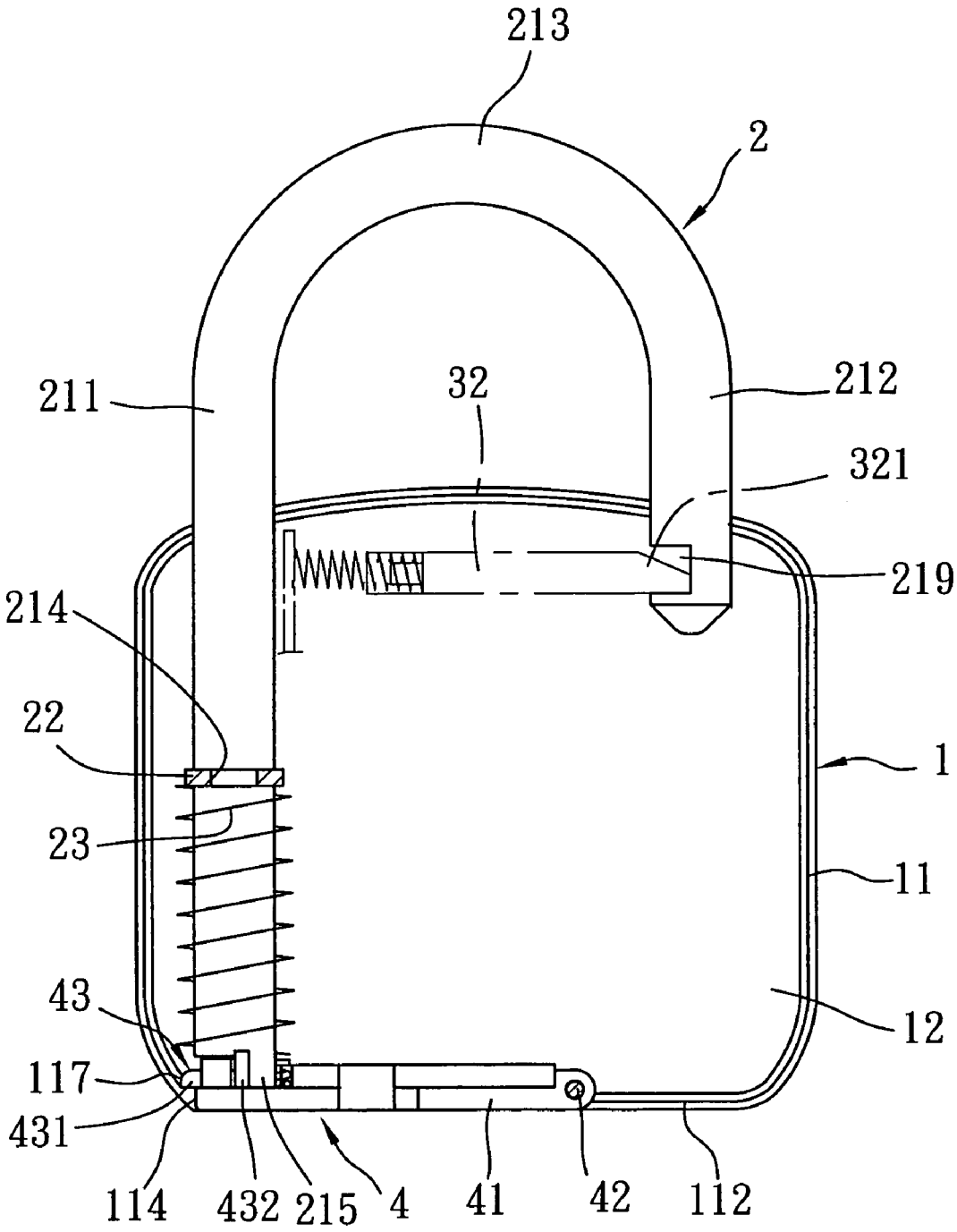
FIG. 2 is a fragmentary schematic front view of the preferred embodiment to illustrate a shackle member when locked to a lock casing.
Figure 3:
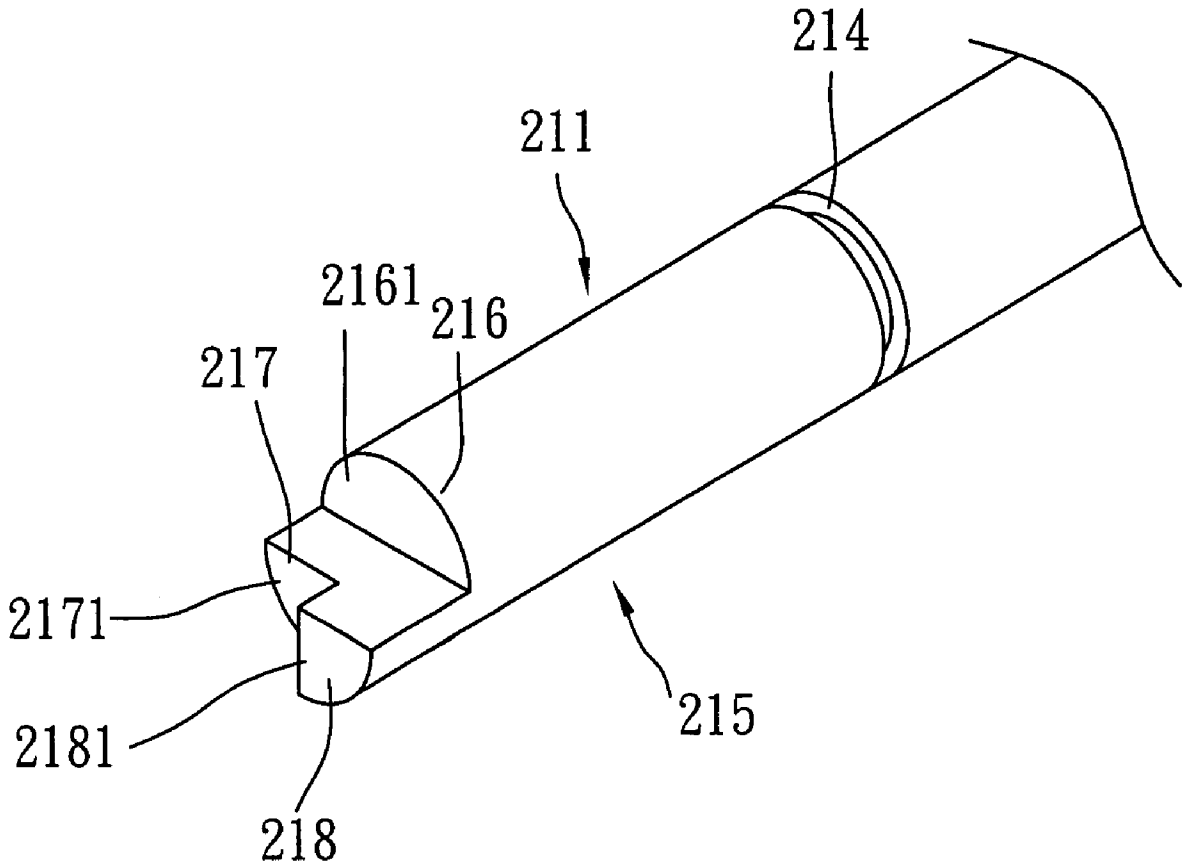
FIG. 3 is a fragmentary perspective view to illustrate a release-control segment on a leg portion of the shackle member.

Referring to FIGS. 1 to 3, the preferred embodiment of an electric padlock according to the present invention is shown to include a lock casing 1, an inverted U-shaped shackle member 2, a latch member 32, and a battery cap unit 4.

The lock casing 1 is formed from a pair of complementary casing parts 11, and confines a receiving space 12 adapted for receiving a battery unit 34 therein. When the casing parts 11 are assembled, the lock casing 1 is configured with a first end wall 113, a second end wall 112 opposite to the first end wall 113, and a pair of side wall parts 111 that extend between and that interconnect the first and second end walls 113, 112. The first end wall 113 is formed with first and second shackle insert holes 115, 116. The second end wall 112 is formed with a battery access hole 114 that permits insertion of the battery unit 34 into and removal of the battery unit 34 from the receiving space 12. The lock casing 1 is further formed with an insert groove 117 in spatial communication with the receiving space 12 and disposed adjacent to the battery access hole 114.

The shackle member 2 has first and second leg portions 211, 212 that are extended movably into the lock casing 1 at the first and second shackle insert holes 115, 116, respectively, and a curved connecting portion 213 that interconnects upper ends of the first and second leg portions 211, 212. The first leg portion 211 is longer than the second leg portion 212, is formed with a retaining groove 214 for engaging a retaining ring 22, and is provided with a release-control segment 215 adjacent to the battery access hole 114. The release-control segment 215 will be described in greater detail in the succeeding paragraphs. The electric padlock further includes a biasing member 23, in the form of a coil spring, sleeved on the shackle member 2 and disposed between the retaining ring 22 and the release-control segment 215 for biasing the shackle member 2 away from the second end wall 112 of the lock casing 1. In this embodiment, the second leg portion 212 is formed with a shackle groove 219 that confronts the first leg portion 211. In other embodiments, the shackle groove may be formed in the first leg portion instead.

The latch member 32 is a spring-loaded member that is received in the lock casing 1 and that has a latching portion 321 adjacent to the second leg portion 212 of the shackle member 2. The latch member 32 is movable between a locking position (see FIG. 2) in which the latching portion 321 of the latch member 32 engages the shackle groove 219 in the second leg portion 212 so as to lock the shackle member 2 on the lock casing 1, and an unlocking position (see FIG. 5) in which the latching portion 321 of the latch member 32 is disengaged from the shackle groove 219 in the second leg portion 212 so as to unlock the shackle member 2 from the lock casing 1.

The electric padlock of this embodiment further includes an electric control unit 3 that is received in the receiving space 12, that includes a drive motor 31 coupled to the latch member 32, and that is adapted to draw electric power from the battery unit 34 in the receiving space 12. The electric control unit 3 is operable so as to drive movement of the latch member 32 from the locking position to the unlocking position. Since the feature of the present invention does not reside in the particular configuration of the electric control unit 3, which is conventional in construction, a detailed description of the same is dispensed with herein for the sake of brevity.

In this embodiment, the electric padlock further includes a known key-operated mechanism 33 coupled to the latch member 32 and manually operable with the use of a key (not shown) for driving the latch member 32 from the locking position to the unlocking position.

The battery cap unit 4 includes a battery cap member 41 and a retaining member 43. The battery cap member 41 is mounted movably on the lock casing 1 for closing selectively the battery access hole 114. In this embodiment, the battery cap member 41 includes a cover body 411 connected pivotally to the second end wall 112 of the lock casing 1 by means of a pivot axle 42. A top side of the cover body 411 is disposed to confront the receiving space 12, and is formed with a battery positioning seat 412 adapted for positioning the battery unit 34 received in the receiving space 12. The retaining member 43 is provided movably on the cover body 411, is disposed in the receiving space 12 when the battery cap member 41 closes the battery access hole 114, and includes an insert portion 431 for removable engagement with the insert groove 117 of the lock casing 1, and a driven portion 432 transverse to the insert portion 431 and driven by the release-control segment 215 (to be described in greater detail hereinafter) of the shackle member 2. The insert portion 431 has a tapered distal end face 433 in this embodiment. The top side of the cover body 411 is further formed with a retainer seat 414 that includes a pair of lateral walls 415 interconnected by a top wall 416, thereby configuring the retainer seat 414 with a guide channel 417 in sliding engagement with the insert portion 431 for guiding movement of the retaining member 43 on the battery cap member 41. The retaining member 43 is movable on the battery cap member 41 between a retaining position, where the retaining member 43 engages the insert groove 117 so as to inhibit opening movement of the battery cap member 41, and a releasing position, where the retaining member 43 is disengaged from the insert groove 117 so as to permit opening movement of the battery cap member 41. The battery cap unit 4 further includes a biasing unit 44 for biasing the retaining member 43 to the retaining position. In this embodiment, the biasing unit 44 is a torsion spring mounted on the cover body 411 and having opposite ends that abut respectively against the battery positioning seat 412 and the driven portion 432 of the retaining member 43.

As best shown in FIG. 3, the release-control segment 215 is formed with a bottom end part 218 disposed to abut against the second end wall 112 of the lock casing 1, and a drive part 217 for driving the driven portion 432 of the retaining member 43. In this embodiment, the first leg portion 211 of the shackle member 2 has a circular cross-section, the bottom end part 218 has an end face 2181 in the shape of a 90-degree circular sector, and the drive part 217 has an end face 2171 in the shape of a 90-degree circular sector and disposed above and angularly offset from the end face 2181 of the bottom end part 218. The release-control segment 215 is further formed with a base part 216 having a semi-circular end face 2161 disposed above the end face 2171 of the drive part 217 and angularly offset from the end faces 2181, 2171 of the bottom end part 218 and the drive part 217. The end face 2161 of the base part 216 is disposed immediately above the retaining member 43 when the shackle member 2 is locked to the lock casing 1. The parts 216, 217, 218 thus configure the release-control segment 215 with a two-step configuration.

Figure 4:
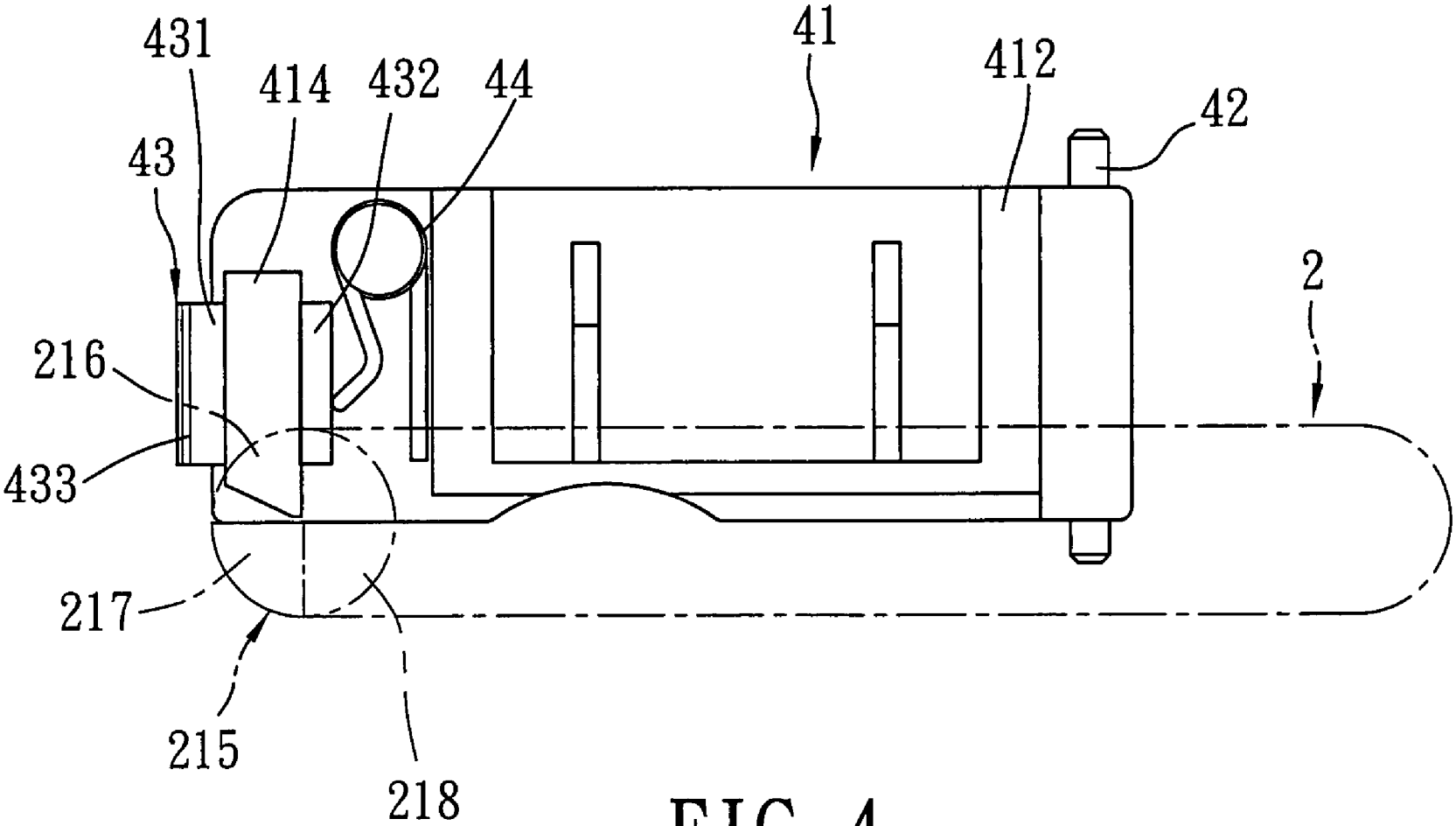
FIG. 4 is a fragmentary schematic top view of the preferred embodiment to illustrate relation between a battery cap unit and a locked state of the shackle member.

Referring to FIGS. 1, 2 and 4, when the battery cap member 41 closes the battery access hole 114 and the shackle member 2 is locked on the lock casing 1, the biasing member 23 is in a compressed state, the latching portion 321 of the latch member 32 engages the shackle groove 219 in the second leg portion 212 of the shackle member 2, the base part 216 of the release-control segment 215 is disposed immediately above the retaining member 43, and the insert portion 431 of the retaining member 43 engages the insert groove 117 in the lock casing 1. Opening movement of the battery cap member 41 is not possible at this time.

Figure 5:
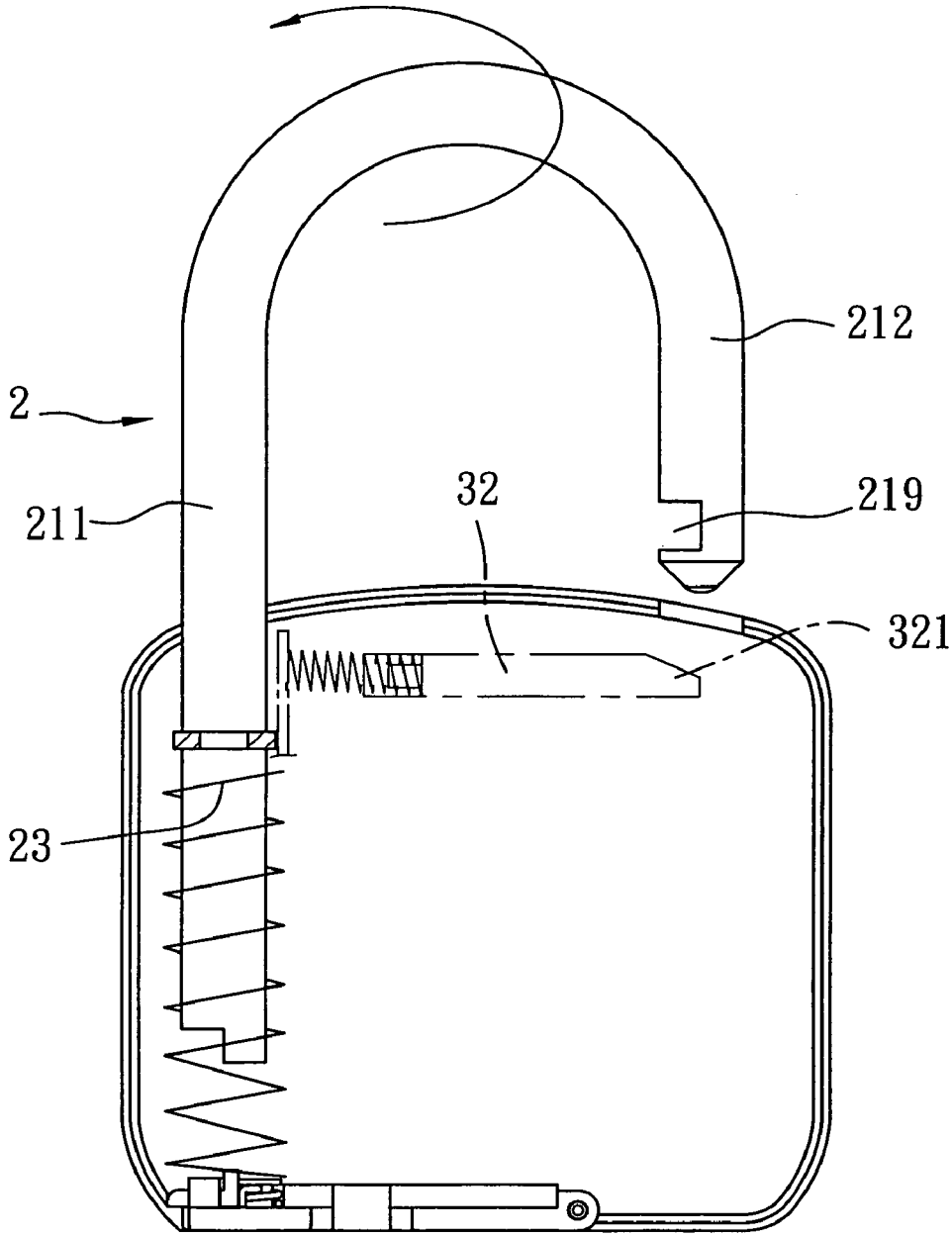
FIG. 5 is a view similar to FIG. 2, but illustrating the shackle member when unlocked from the lock casing.

Referring to FIGS. 1 and 5, when the shackle member 2 is unlocked from the lock casing 1, such as through operation of either the drive motor 31 of the electric control unit 3 or the key-operated mechanism 33, the latching portion 321 of the latch member 32 is disengaged from the shackle groove 219 in the second leg portion 212 of the shackle member 2, and the shackle member 2 moves upward due to the biasing force of the biasing member 23. The shackle member 2 can be rotated relative to the lock casing 1 about the first leg portion 211 at this time.

Figure 6:
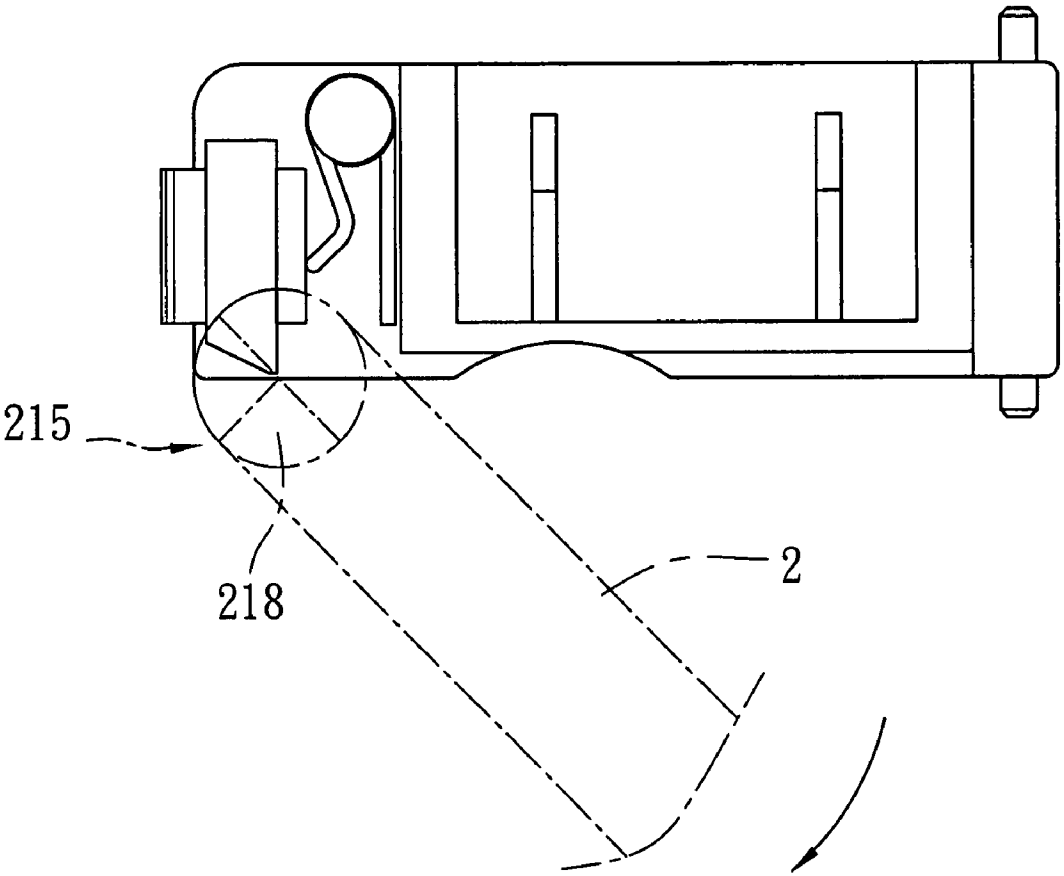
FIG. 6 is a view similar to FIG. 4, but illustrating the shackle member when unlocked from the lock casing and subsequently rotated by a 45-degree angle.
Figure 7:
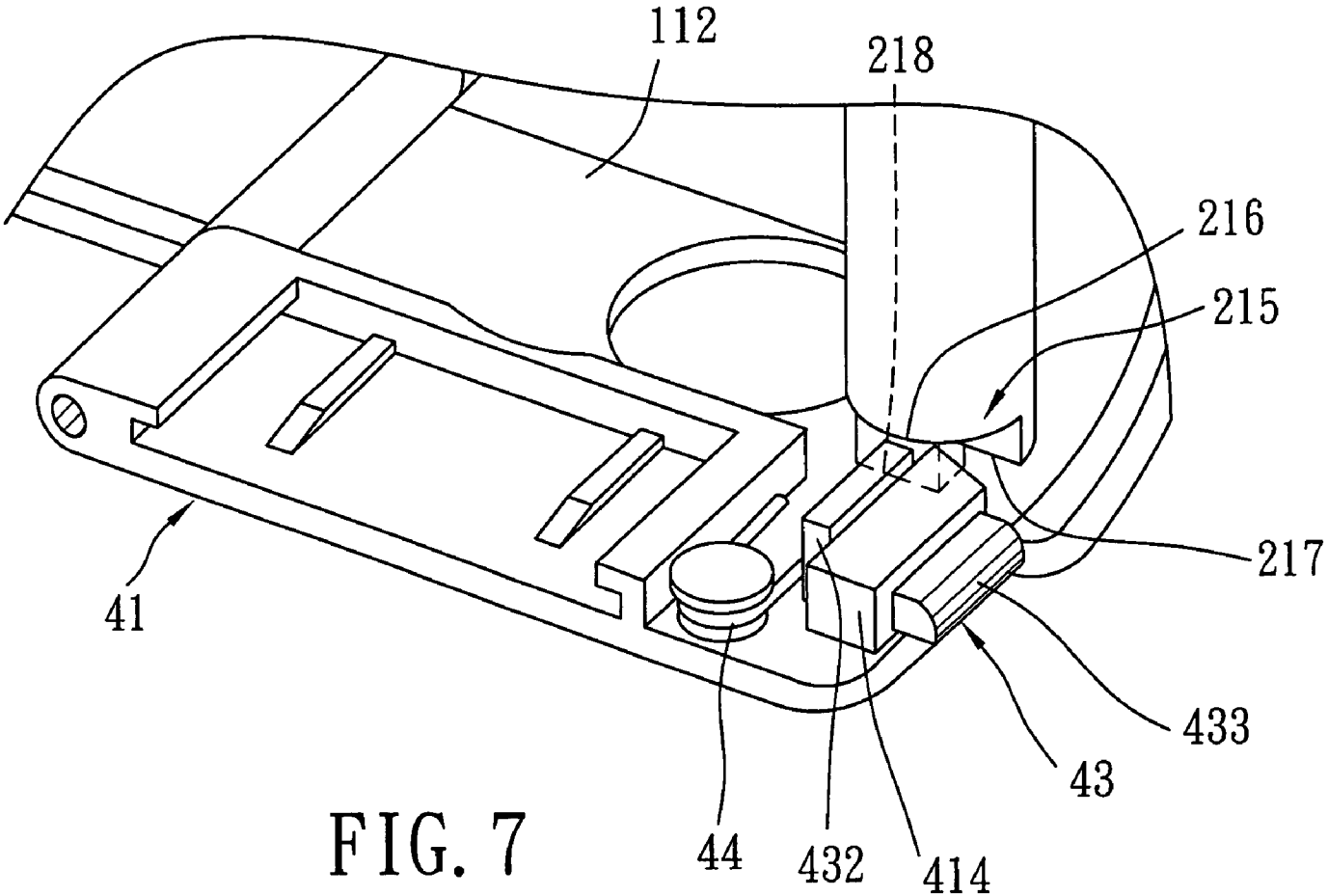
FIG. 7 is a fragmentary perspective view of the preferred embodiment corresponding to the state shown in FIG. 6.
Figure 8:
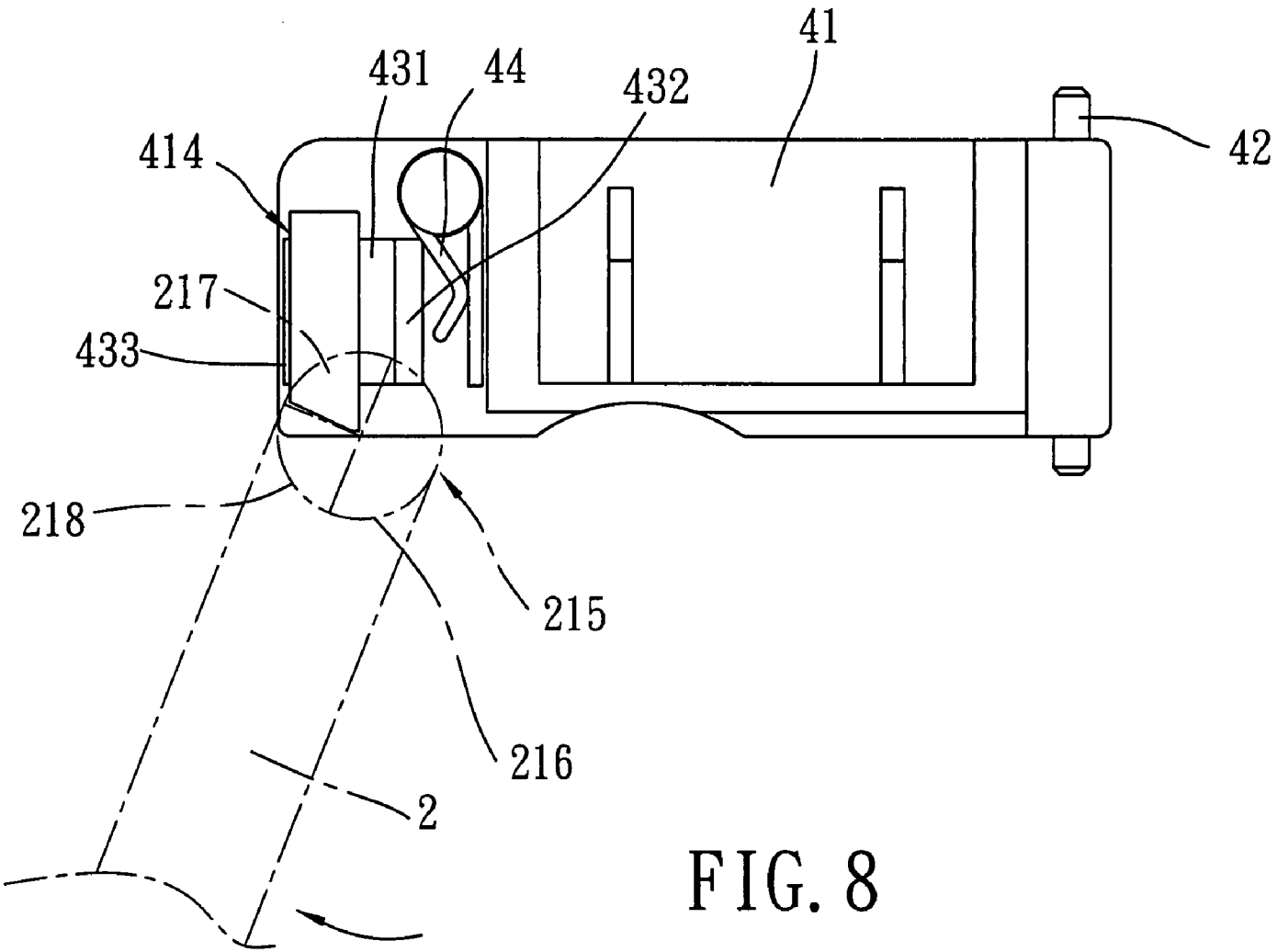
FIG. 8 is a view similar to FIG. 4, but illustrating the shackle member when driving movement of a retaining member of the battery cap unit.
Figure 9:
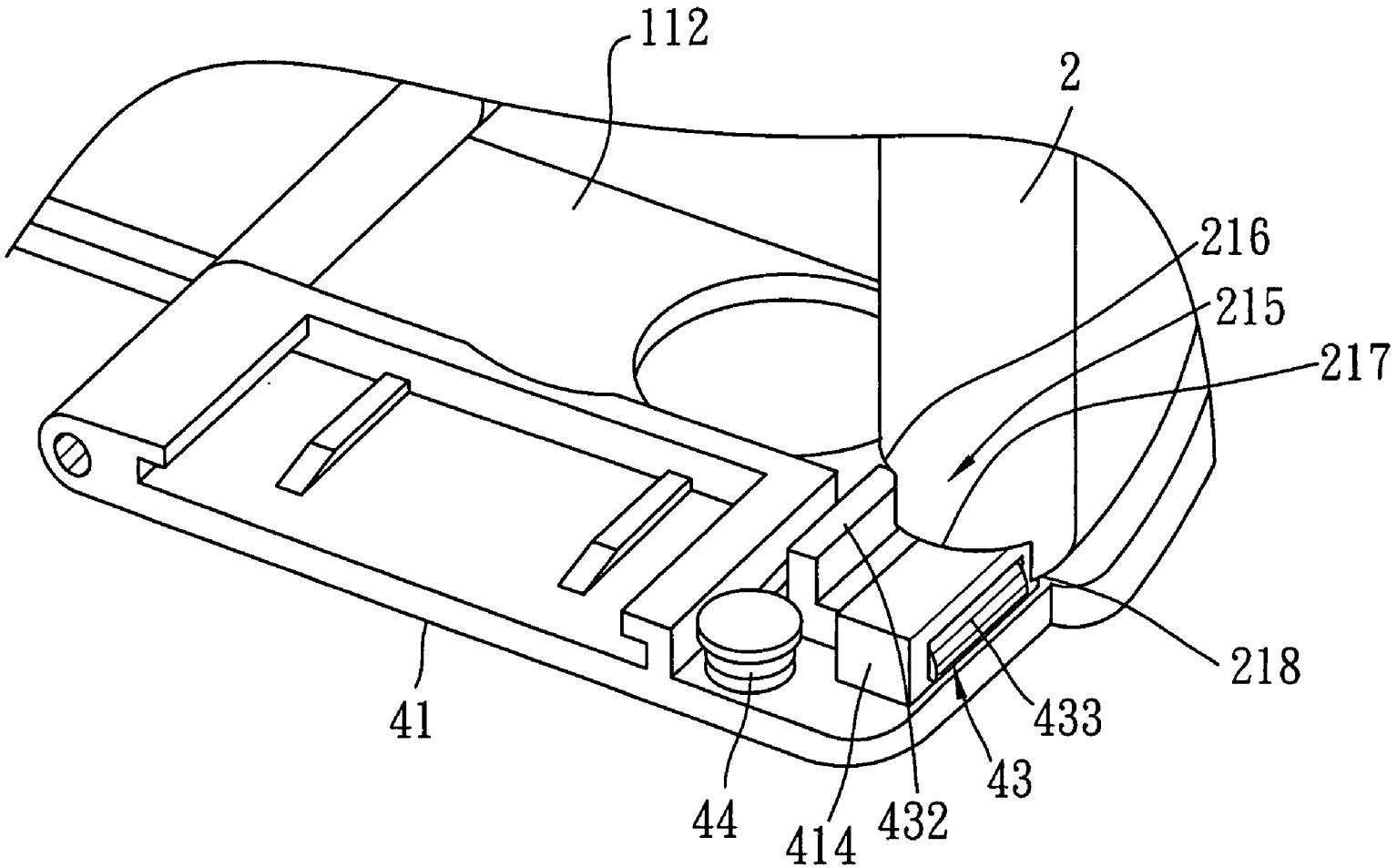
FIG. 9 is a fragmentary perspective view of the preferred embodiment corresponding to the state shown in FIG. 8.

Referring to FIGS. 1, 6 and 7, when the shackle member 2 is unlocked from the lock casing 1, the release-control segment 215 moves upward as well due to the biasing force of the biasing member 23. At this time, when it is desired to open the battery access hole 114 to replace the battery unit 34, the following operations are performed. First, as shown in FIG. 6, the shackle member 2 is rotated in a clockwise direction relative to the lock casing 1 by an angle of about 45 degrees. The shackle member 2 is then pressed toward the lock casing 1 against the biasing action of the biasing member 23 to result in abutment between the bottom end part 218 of the release-control segment 215 and the second end wall 112 of the lock casing 1, as shown in FIG. 7. Thereafter, referring to FIGS. 1, 8 and 9, the shackle member 2 is rotated further in the clockwise direction relative to the lock casing 1 such that the drive part 217 of the release-control segment 215 abuts against the driven portion 432 and drives movement of the retaining member 43 against the biasing force of the biasing unit 44 from the retaining position to the releasing position, i.e., the insert portion 431 of the retaining member 43 is moved to disengage from the insert groove 117 in the lock casing 1, thereby permitting subsequent downward pivoting of the battery cap member 41 about the pivot axle 42 for opening the battery access hole 114.

To close the battery access hole 114, the battery cap member 41 is simply pivoted toward the battery access hole 114. By virtue of the tapered design of the distal end face 433 of the insert portion 431 of the retaining member 43, contact between the distal end face 433 and the hole-defining periphery of the second end wall 112 of the lock casing 1 permits movement of the retaining member 43 against the biasing force of the biasing unit 44 until the retaining member 43 is once again disposed in the receiving space 12, during which time the insert portion 431 of the retaining member 43 engages the insert groove 117 due to the biasing force of the biasing unit 44.

It has thus been shown that removal of the battery unit 34 from the lock casing 1 in the electric padlock of this invention is possible only when the shackle member 2 is unlocked from the lock casing 1. The object of the invention is achieved accordingly.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electric padlock comprising:

a lock casing confining a receiving space that is adapted for receiving a battery unit, and having a first end wall that is formed with first and second shackle insert holes, and a second end wall that is opposite to said first end wall and that is formed with a battery access hole, said battery access hole permitting insertion of the battery unit into and removal of the battery unit from said receiving space, said lock casing being formed with an insert groove in spatial communication with said receiving space and disposed adjacent to said battery access hole;

an inverted U-shaped shackle member having first and second leg portions that are extended movably into said lock casing at said first and second shackle insert holes, respectively, one of said first and second leg portions being formed with a shackle groove;

a latch member received in said lock casing and movable between a locking position in which said latch member engages said shackle groove so as to lock said shackle member on said lock casing, and an unlocking position in which said latch member is disengaged from said shackle groove so as to unlock said shackle member from said lock casing; and a battery cap unit including a battery cap member mounted movably on said lock casing for closing selectively said battery access hole, and a retaining member provided movably on said battery cap member, disposed in said receiving space when said battery cap member closes said battery access hole, and movable between a retaining position, where said retaining member engages said insert groove so as to inhibit opening movement of said battery cap member, and a releasing position, where said retaining member is disengaged from said insert groove so as to permit opening movement of said battery cap member;

wherein one of said first and second leg portions of said shackle member is provided with a release-control segment adjacent to said battery access hole such that, when said shackle member is un locked from said lock casing and is subsequently rotated relative to said lock casing, said release-control segment is capable of driving movement of said retaining member from the retaining position to the releasing position.

2. The electric padlock as claimed in claim 1, wherein said retaining member includes an insert portion for removable engagement with said insert groove, and a driven portion transverse to said insert portion and driven by said release-control segment.

3. The electric padlock as claimed in claim 2, wherein said release-control segment is formed with a bottom end part disposed to abut against said second end wall, and a drive part for driving said driven portion of said retaining member, said drive part being disposed above and being angularly offset from said bottom end part, wherein, when said shackle member is unlocked from said lock casing, is subsequently rotated relative to said lock casing, is then pressed toward lock casing to result in abutment between said bottom end part of said release-control segment and said second end wall of said lock casing, and is thereafter rotated further relative to said lock casing, said drive part drives said driven portion to move said retaining member from the retaining position to the releasing position.

4. The electric padlock as claimed in claim 3, wherein said release-control segment is further formed with a base part disposed above said drive part and angularly offset from said bottom end part and said drive part, said base part being disposed immediately above said retaining member when said battery cap member closes said battery access hole and said shackle member is locked to said lock casing.

5. The electric padlock as claimed in claim 1, wherein said battery cap member is connected pivotally to said second end wall of said lock casing.

6. The electric padlock as claimed in claim 5, further comprising a pivot axle for connecting pivotally said battery cap member to said second end wall.

7. The electric padlock as claimed in claim 1, wherein said battery cap unit further includes a biasing unit for biasing said retaining member to the retaining position.

8. The electric padlock as claimed in claim 7, wherein said biasing unit includes a torsion spring.

9. The electric padlock as claimed in claim 2, wherein said battery cap member is formed with a guide channel in sliding engagement with said insert portion for guiding movement of said retaining member on said battery cap member.

10. The electric padlock as claimed in claim 1, wherein said battery cap member has a top side to confront said receiving space and formed with a battery positioning seat adapted for positioning the battery unit received in said receiving space.

11. The electric padlock as claimed in claim 1, wherein said first leg portion is longer than said second leg portion and is formed with said release-control segment.

12. The electric padlock as claimed in claim 1, further comprising a biasing member for biasing said shackle member away from said second end wall of said lock casing.

13. The electric padlock as claimed in claim 11, wherein said shackle groove is formed in said second leg portion of said shackle member.

14. The electric padlock as claimed in claim 1, further comprising an electric control unit received in said receiving space, coupled to said latch member, and adapted to draw electric power from the battery unit in said receiving space, said electric control unit being operable so as to drive movement of said latch member from the locking position to the unlocking position.

* * * * *